United States Patent [19]

Nelson

[11] 4,405,009

[45] Sep. 20, 1983

[54] METHOD AND APPARATUS FOR MEASURING INGOT PRODUCTION

[75] Inventor: Warren J. Nelson, Hanover County, Va.

[73] Assignee: Reynolds Metals Company, Richmond, Va.

[21] Appl. No.: 275,320

[22] Filed: Jun. 19, 1981

[51] Int. Cl.[3] ..... B22D 11/16; B22D 11/124

[52] U.S. Cl. ..... 164/413; 164/444

[58] Field of Search ..... 164/4.1, 413, 444, 454, 164/457, 487, 154

[56] References Cited

U.S. PATENT DOCUMENTS

| | | | |
|---|---|---|---|
| 1,474,261 | 11/1923 | Hosack . | |
| 3,441,079 | 4/1969 | Bryson | 164/487 |
| 3,649,450 | 3/1972 | Barton | 176/19 |
| 3,739,276 | 6/1973 | Dornberger | 324/161 |
| 3,782,565 | 1/1974 | Doran et al. | 214/16.4 A |
| 3,856,403 | 12/1974 | Maughmer et al. | 356/28 |
| 3,882,474 | 5/1975 | Cain | 340/177 CA |
| 4,011,901 | 3/1977 | Flemings et al. | 164/457 |
| 4,154,669 | 5/1979 | Goetz | 204/299 R |

OTHER PUBLICATIONS

"Model DV301 Position Velocity Transducer", Bulletin, Celesco Transducer Products, Inc.

*Primary Examiner*—Gus T. Hampilos
*Assistant Examiner*—Jerold L. Johnson
*Attorney, Agent, or Firm*—Alan T. McDonald

[57] ABSTRACT

A method and apparatus are disclosed for measuring the displacement and velocity of metal ingots, such as aluminum ingots, during direct chill casting thereof. A tube rests on the table carrying the ingot and travels with this table. Attached to this tube is a cable, forming a part of a linear velocity transducer, which transducer senses movement in the cable and correlates this movement to the velocity and displacement of the mold.

4 Claims, 2 Drawing Figures

METHOD AND APPARATUS FOR MEASURING INGOT PRODUCTION

BACKGROUND OF THE INVENTION

Metallic ingots, notably aluminum, copper, steel and the like, are routinely produced from molten metal using the direct chill (DC) method. In this method of ingot production, a table is positioned beneath a plate having one or more molds mounted therethrough, which plate is fed molten metal, with water being aimed at the sides of the mold. This water chills the molten metal and causes solidification of the metal. The table is lowered and additional molten metal is continuously added to the top of the ingot, chilled and solidified, eventually resulting in a complete ingot which may have a length of 200 inches (508 centimeters) or more.

Control of the vertical movement of the table beneath the mold or molds is vital to successful ingot production. If the table is lowered too slowly, an excessive cooling rate for the metal occurs, resulting in cracks in the ingot and a useless product. On the other hand, should the table be lowered too quickly, insufficient solidification of the metal may occur, resulting in spilling into the casting pit of molten metal.

Thus, for each metal composition, there is an ideal rate of mold velocity, based upon the metal temperature, the size of the mold, the amount and temperature of cooling water and the metal composition.

In the past, two methods have been employed for determining mold velocity. In one method, a rod rests on the top of the mold table. As the rod passes a given point, the operator of the casting station places a mark on the rod, at specific time intervals. By noting the distance between markings passing this point, the operator determines the average mold velocity, making adjustments as he believes necessary. This, of course, is a crude calculation, depending on eyeball sightings of movements as small as 1.0 inch (2.54 centimeters)/minute, and does not lend itself to an automated operation whereby continual calculations and modifications of table velocity to produce high quality ingots could be accomplished.

The other method commonly employed for measuring mold velocity is based on the fact that the table carrying the mold is hydraulically operated. Thus, as the table moves downwardly, hydraulic fluid is displaced. The operator can measure, through flow meter and other techniques, the rate of fluid displacement and correlate this to table velocity. However, such a system cannot account for leaks in the hydraulic system and is thus inaccurate.

It is thus desirable to provide a method and apparatus for determining mold velocity which measures mold velocity directly, i.e., without indirect measurement of secondary occurrences to calculate mold velocity, and which permits continuous measurement of this velocity for an automated optimization of mold velocity.

THE PRESENT INVENTION

In accordance with the present invention, these desired results are obtained. The present invention comprises a method and apparatus for measuring mold table velocity and displacement in which a tube sits on the top of the mold table. This tube has attached thereto at its opposite end one end of a cable, with the cable end thus moving at the same rate as the tube and the table.

At the other end of this cable is a linear velocity transducer. This apparatus electronically converts the movements of the cable to digital velocity and displacement measurements for the table, both in digital readout display and electronic format. The display permits an operator looking at the transducer readout to note changes in velocity and displacement, permitting him to manually adjust the system. The electronic readouts permit automation of the casting system by linking this readout to control means for varying the rate of hydraulic fluid displacement, thus providing a closed-loop feedback velocity control mechanism.

BRIEF DESCRIPTION OF THE DRAWINGS

The method and apparatus of the present invention will be more fully described with reference to the drawings in which.

DETAILED DESCRIPTION OF THE PREFERRED EMBODIMENT

Figure 1:
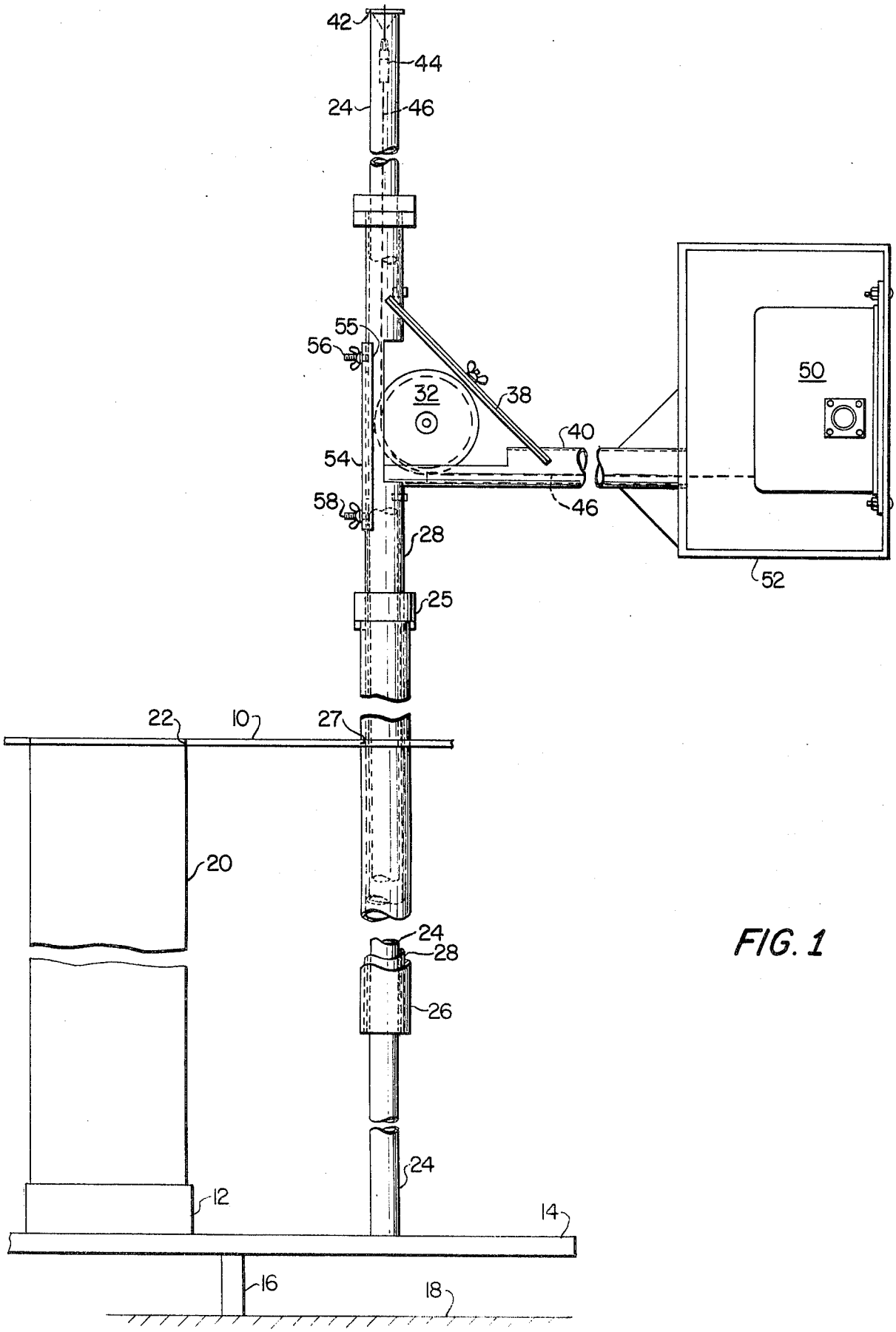
FIG. 1 is a front elevational view of the system of the present invention.
Figure 2:
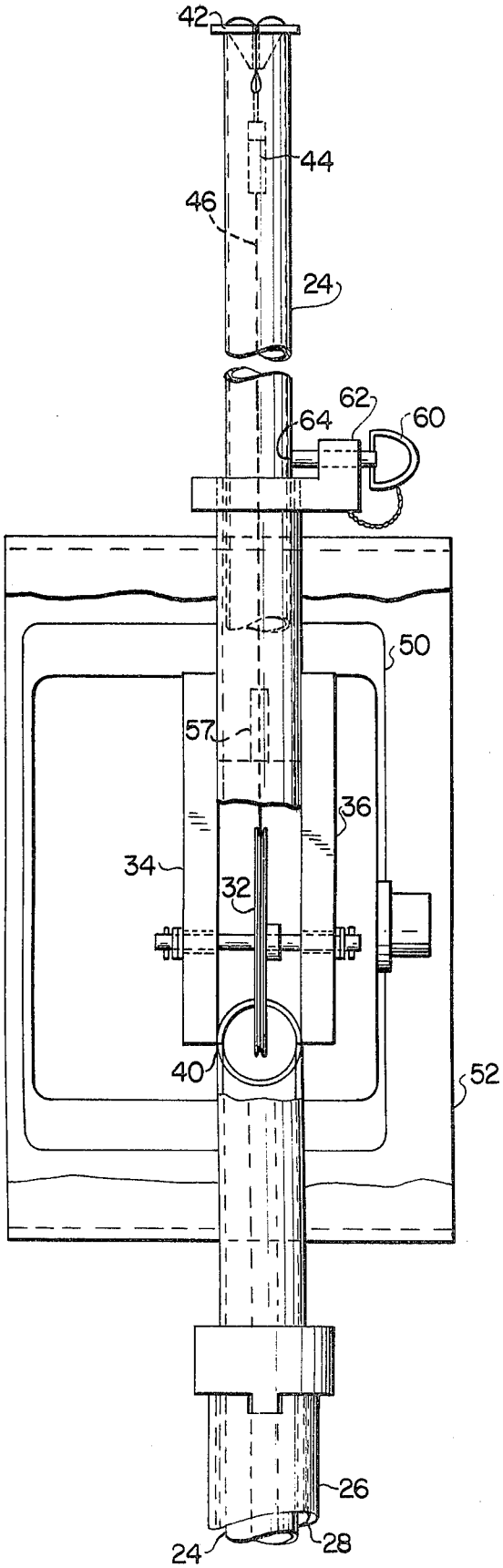
FIG. 2 is a partial left side elevational view, with certain parts removed, of the measuring device.

Turning to the FIGURES, a vertical direct chill casting apparatus is diagramatically described. The casting system includes a top mold 10 and one or more stools 12, said stools 12 being carried upon a table 14 which is driven vertically by means of piston 16 protruding from the floor 18 of the casting room. Ingots 20 are produced by pouring molten metal, such as aluminum, (not shown) through apertures 22 in the top mold 10 and cooling this molten metal by means of cooling fluid, such as water (not shown).

Control of the rate of ingot formation is accomplished through control of piston 16. Piston 16 is hydraulic, and increases and decreases in the level of hydraulic fluid within a cylinder (not shown) regulates vertical movements of piston 16. It is this movement which is sought to be controlled by the present invention.

Sitting on the table 14 is a tube or rod 24. Tube 24 fits within sleeve 26, which sleeve 26 passes through an aperture 27 in top mold 10 and is fixed to top mold 10 by means such as welding. Thus, vertical movements of mold table 14 produce corresponding movements in tube 24, which tube 24 is thus slidably mounted within sleeve 26. Tube 24 also passes within the vertical leg of a generally T-shaped support member 28. Support 28 is positioned within sleeve 26 and tube 24 is positioned and slidably mounted within support 28. Stop 25 mounted on the bottom of the vertical leg of support member 28 to properly position it within sleeve 26.

A freely-rotating guide wheel 32 is mounted between a pair of face plates 34 and 36 (not shown in FIG. 1) and a top plate 38. The purpose of guide wheel 32 will be more fully described below.

At the uppermost end of tube 24 is an end cap 42. End cap 42 has attached thereto the end connector 44 of a cable 46. Cable 46 passes through tube 24 and, after passing partially around guide wheel 32 and into the horizontal leg 40 of T-shaped support 28, is finally attached at its other end to transducer 50 mounted within housing 52. The length of horizontal leg 40 is designed to be sufficient to keep transducer 50 away from the elevated temperatures surrounding the top mold 10 and will vary with different molds.

To accomplish threading of cable 46 around the guide wheel 32, plate 54 is provided having connectors 56 and 58, such as wing nuts, to remove plate 54 and permit access through an opening 55 in support 28.

Clearly, tube 24 travels vertically with table 14. As this occurs, cable 46, which is spring-mounted within transducer 50, will move at the same rate as tube 24, and thus as table 14.

To enable table 24 to move vertically past guide wheel 32, tube 24 includes a longitudinal slot 57 along a major portion of its length. The slot 57 does not extend the full length of tube 24, so that tube 24 cannot be removed through support 28 when the unit is assembled.

Typical of transducers which may be employed is model DV301-200, produced by Calesco Transducer Products, Inc. Movements of cable 46 are continuously sensed by transducer 50 and, due to the internal electronics within transducer 50, are continuously translated into digital readouts of the velocity and displacement of cable 56, and thus of table 14. These readout figures may then be observed by the operator of the casting operation, who can then manually increase or decrease the rate of mold movement as necessary.

The output of transducer 50 may be used in another manner. Electronic signals from transducer 50 could be fed to a minicomputer or other such equipment which has been programmed for the optimum varied drop rate for a given alloy, based upon the alloy characteristics, rate of cooling, mold size and the like. The minicomputer, having this input on current drop rate, could then automatically adjust the hydraulic cylinder 16 to provide an optimum drop.

In yet another configuration, the transducer 50 could be linked to an alarm mechanism, such that should the drop rate falls below a minimum amount, an alarm will sound, so that corrective action can occur before molten metal spills into the casting pit.

An important feature of the system of the present invention is the fact that all measurements of velocity and displacement are made above the top mold 10. The area beneath this plate is dirty and wet, due to the nature of the casting operation. Thus, it is undesirable to attempt measurements within this region, as equipment for such measurements may quickly deteriorate or be easily damaged. Employing the system of the present invention, however, all elements, other than rod 24 and sleeve 26, are outside of the casting operation, and thus not subject to such rapid deterioration or damage.

When the unit is not in operation, key 60, having its mounting 62 mounted on the vertical leg of support 28 may be inserted into an opening 64 in rod 24 to lock rod 24 in place.

From the foregoing, it is clear that the present invention provides a simple, accurate method and apparatus for measuring mold operations.

While the invention has been described with reference to certain specific embodiments thereof, it is not intended to be so limited thereby, except as set forth in the following claims.

I claim:

1. In an apparatus for forming a metallic ingot comprising a top mold, a hydraulically driven table and at least one stool carried by said table upon which said ingot is formed, the improvement comprising means for measuring the velocity and displacement of said table, said measuring means comprising a first tube fixedly mounted to and passing through said top mold, a second tube passing through said first tube and constructed and arranged to move with said table, a transducer, said transducer including an extendable and retractable cable as a portion thereof, said cable being connected to said second tube above said top mold, and means for fixedly mounting said transducer with respect to said second tube.

2. The apparatus of claim 1 further comprising alarm means connected to said transducer, said alarm means providing a signal should said velocity of said table fall below a predetermined amount.

3. The apparatus of claim 1 further comprising means responsive to the output of said transducer for varying said velocity of said table to produce a predetermined drop rate for said table.

4. The apparatus of claim 1 wherein said means for fixedly mounting comprises a housing within which said transducer is mounted, a third tube, said third tube being connected to said housing at one end thereof and being connected to said first tube generally perpendicular thereto, and a pulley for guiding said cable between said second tube and said third tube.

* * * * *